US007947215B2

(12) United States Patent
Ito et al.

(10) Patent No.: US 7,947,215 B2
(45) Date of Patent: May 24, 2011

(54) HEAT TREATMENT APPARATUS, HEAT TREATMENT METHOD, AND RECORDING MEDIUM STORING COMPUTER PROGRAM CARRYING OUT THE SAME

(75) Inventors: Hikaru Ito, Minato-ku (JP); Shinji Okada, Koshi (JP); Masami Yamashita, Minato-ku (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 12/788,981

(22) Filed: May 27, 2010

(65) Prior Publication Data

US 2010/0236477 A1 Sep. 23, 2010

Related U.S. Application Data

(62) Division of application No. 11/734,424, filed on Apr. 12, 2007, now Pat. No. 7,745,347.

(30) Foreign Application Priority Data

Apr. 26, 2006 (JP) ..... 2006-122455

(51) Int. Cl.
*B05C 11/00* (2006.01)

(52) U.S. Cl. ..... 266/94; 266/99; 118/708

(58) Field of Classification Search ..... 266/78, 266/94, 99; 118/708
See application file for complete search history.

(56) References Cited

U.S. PATENT DOCUMENTS

| | | | | |
|---|---|---|---|---|
| 6,191,394 | B1 * | 2/2001 | Shirakawa et al. | 219/444.1 |
| 2007/0218706 | A1 | 9/2007 | Matsuoka | |
| 2007/0286709 | A1 | 12/2007 | Fujii et al. | |

FOREIGN PATENT DOCUMENTS

| | | |
|---|---|---|
| JP | 2000-068176 (A) | 3/2000 |
| JP | 2001-358045 (A) | 12/2001 |
| JP | 2002-93799 | 3/2002 |
| JP | 2003-347305 | 12/2003 |

OTHER PUBLICATIONS

Notice of Grounds of Rejection mailed Oct. 19, 2010 in Japanese Patent Appln. No. 2006-122455, drafting date Oct. 13, 2010 (with English langusage translation).

* cited by examiner

*Primary Examiner* — Scott Kastler
(74) *Attorney, Agent, or Firm* — Oblon, Spivak, McClelland, Maier & Neustadt, L.L.P.

(57) ABSTRACT

An experiment is conducted in advance, for finding a temperature of a cooling plate attained as a result of balancing between a temperature of a substrate after heat treatment and a temperature of the cooling plate at the time of cooling of the substrate. Then, before heat treatment of a first substrate, the cooling plate is moved to a position above a hot plate, the cooling plate is heated to that temperature, and thereafter heat treatment of the substrate is started.

9 Claims, 18 Drawing Sheets

| RECIPE NUMBER | HEAT TREATMENT TEMPERATURE t2 OF WAFER W (°C) | STABILIZATION TEMPERATURE OF COOLING PLATE 33 (°C) |
|---|---|---|
| 1 | 90 | 50 |
| 2 | 110 | 60 |
| 3 | 130 | 70 |
| 4 | 150 | 80 |
| 5 | 170 | 90 |
| ⋮ | ⋮ | ⋮ |

HEAT TREATMENT APPARATUS, HEAT TREATMENT METHOD, AND RECORDING MEDIUM STORING COMPUTER PROGRAM CARRYING OUT THE SAME

CROSS-REFERENCE TO RELATED APPLICATIONS

This application is a divisional of U.S. patent application Ser. No. 11/734,424, filed Apr. 12, 2007, now U.S. Pat. No. 7,745,347, and is based on and claims priority to Japanese patent application No. 2006-122455, filed Apr. 26, 2006. The entire content of U.S. Pat. No. 7,745,347 is hereby incorporated by reference.

BACKGROUND OF THE INVENTION

1. Field of the Invention

The present invention relates to a heat treatment apparatus including a hot plate portion for heat treatment of a substrate such as a semiconductor wafer to which a coating liquid is applied and a cooling plate for transferring the substrate that has been subjected to heat treatment, as well as to a heat treatment method.

2. Description of the Background Art

A coating and development apparatus for applying a resist to a substrate and developing the exposed substrate has been used as an apparatus for forming a resist pattern on a substrate such as a semiconductor wafer (hereinafter, referred to as a wafer) or a glass substrate for an LCD (liquid crystal display). In the apparatus, a heat treatment apparatus referred to, for example, as a baking apparatus, is incorporated. In an apparatus for heating the substrate to which a resist liquid is applied, for example, the heat treatment apparatus serves to dry a solvent in the resist liquid, while in an apparatus for heating the substrate after exposure using a chemically amplified resist, the heat treatment apparatus serves to diffuse acid in the resist.

FIG. 18 shows an exemplary structure of a heat treatment apparatus 100. In heat treatment apparatus 100, a cooling plate 104 and a heat treatment portion having wafer elevation mechanisms 106 and 107 respectively are provided. Cooling plate 104 is movable between a position (home position) shown in the drawing and a position above a hot plate 108, by means of a not-shown drive mechanism.

A substrate such as a wafer W transferred from a transfer port 109 into heat treatment apparatus 100 by a not-shown transfer mechanism moves to a position above hot plate 108 by means of cooling plate 104, and placed on hot plate 108. Thereafter, wafer W is subjected to prescribed heat treatment on hot plate 108, and then returns to the home position by means of cooling plate 104. Wafer W is cooled until it is unloaded from heat treatment apparatus 100 by the not-shown wafer W transfer mechanism, for example for 30 seconds.

In conventional heat treatment apparatus 100, in cooling the wafer placed on cooling plate 104, a cooling mechanism such as a Peltier element or a cooling pipe through which a coolant passes has been provided inside or under cooling plate 104. Accordingly, heat treatment apparatus 100 tends to be bulky and maintenance work is complicated. The present inventors have been studying cooling of wafer W by using only the cooling plate, without providing the cooling mechanism as described above.

Meanwhile, with the tendency toward higher throughput in recent years, necessity for reducing a time required for heat treatment per one wafer W has grown. As the time for heating wafer W is required for such a process as drying of the solvent in the resist liquid, it is impossible to reduce such a time. Accordingly, further reduction in the time for cooling wafer W has been demanded. If the cooling mechanism as described above is not provided, however, cooling of cooling plate 104 after cooling of wafer W is not satisfactory, and a temperature of cooling plate 104 gradually increases with the increase in the number of wafers W that are successively treated. Therefore, capability of cooling plate 104 for cooling wafer W becomes insufficient, and the temperature of wafer W is gradually raised with the increase in the number of wafers to be treated. The temperature of cooling plate 104 and the temperature of wafer W tend to be constant as wafers W are successively subjected to heat treatment, however, several to several tens of wafers W have been subjected to heat treatment by that time. Then, difference in a cooled state between wafers W is caused, which results in variation in thickness of a resist film or a pattern among wafers W.

In addition, in spite of provision of a cooling mechanism, if cooling capability thereof is low, similar problem arises. In such a case, capability in cooling cooling plate 104 should be enhanced, for example, by increasing the number of Peltier elements or making a coolant circulating pump or a chiller greater in size.

Japanese Patent Laying-Open No. 2003-347305 describes the technique to increase heater output at the time when a substrate is loaded in a treatment chamber, in order to suppress drawbacks such as lowering in a temperature in the treatment chamber due to initial loading of several substrates into the treatment chamber in successive treatment of the substrate. If the technique described in Japanese Patent Laying-Open No. 2003-347305 is applied to cooling plate 104 described above, the cooling mechanism for cooling cooling plate 104 is required and high cooling capability is required in the cooling mechanism.

SUMMARY OF THE INVENTION

An object of the present invention is to provide a technique to bring closer cooling temperatures after heat treatment of a plurality of substrates to each other, in successive treatment of substrates by using a heat treatment apparatus including a hot plate portion for heat treatment of the substrates and a cooling plate.

A heat treatment apparatus according to the present invention is directed to a heat treatment apparatus for successive heat treatment of substrates, and the heat treatment apparatus includes: a hot plate portion for subjecting the substrate to which a coating liquid is applied to heat treatment; a cooling plate for cooling the substrate; a drive mechanism for moving the cooling plate between a home position where the substrate is passed between the cooling plate and an external transfer mechanism and a position above the hot plate portion where the substrate is passed between the cooling plate and the hot plate portion; a heating mechanism for heating the cooling plate; a temperature detection portion for detecting a temperature of the cooling plate; and a control unit outputting a control signal for controlling an amount of heat received by the cooling plate from the heating mechanism such that a temperature value detected by the temperature detection portion is set to a prescribed temperature before start of successive treatment of the substrate. The control unit outputs the control signal such that a surface temperature of the cooling plate immediately before reception from the hot plate portion, of the substrate to be treated first after start of the successive treatment of the substrates and a surface temperature of the cooling plate immediately before reception from the hot plate portion, of the substrate to be treated second are brought closer to each other.

In the heat treatment apparatus above, preferably, temperature difference between the surface temperature of the cooling plate immediately before reception from the hot plate portion, of the substrate to be treated first after start of the successive treatment and the surface temperature of the cooling plate immediately before reception from the hot plate portion, of the substrate to be treated second is within a range of 10° C.

In the heat treatment apparatus above, in one aspect, the heating mechanism is included in the hot plate portion, and the control signal includes a signal for controlling the drive mechanism in order to adjust a time period during which the cooling plate stays above the hot plate portion.

In the heat treatment apparatus above, in another aspect, the heating mechanism is provided in the cooling plate, and the control signal includes a signal for controlling an amount of heat generated by the heating mechanism.

Preferably, the heat treatment apparatus above further includes a cooling mechanism for forcibly cooling the cooling plate.

In the heat treatment apparatus above, preferably, the substrates include a first substrate and a second substrate treated next to the first substrate, and if a temperature for heat treatment of the second substrate by the hot plate portion is lower than that of the first substrate, the control unit outputs the control signal such that the cooling plate is cooled by the cooling mechanism by the time when the cooling plate receives the second substrate from the external transfer mechanism, after the first substrate is passed from the cooling plate to the external transfer mechanism.

In the heat treatment apparatus above, preferably, the cooling mechanism cools the cooling plate by blowing a gas.

A heat treatment method according to the present invention is directed to a heat treatment method of performing successive heat treatment of substrates using a heat treatment apparatus, the heat treatment apparatus including a hot plate portion for subjecting the substrate to which a coating liquid is applied to heat treatment, a cooling plate for cooling the substrate, a drive mechanism for moving the cooling plate, and a heating mechanism for heating the cooling plate, and the heat treatment method includes the steps of: moving the cooling plate, by means of the drive mechanism, between a home position where the substrate is passed between the cooling plate and an external transfer mechanism and a position above the hot plate portion where the substrate is passed between the cooling plate and the hot plate portion; and heating the cooling plate with the heating mechanism before start of successive treatment of the substrate, in order to bring closer to each other a surface temperature of the cooling plate immediately before reception from the hot plate portion, of the substrate to be treated first after start of the successive treatment of the substrates and a surface temperature of the cooling plate immediately before reception from the hot plate portion, of the substrate to be treated second.

In the heat treatment method above, preferably, temperature difference between the surface temperature of the cooling plate immediately before reception from the hot plate portion, of the substrate to be treated first after start of the successive treatment and the surface temperature of the cooling plate immediately before reception from the hot plate portion, of the substrate to be treated second is within a range of 10° C.

In the heat treatment method above, in one aspect, the step of heating the cooling plate with the heating mechanism includes the step of heating the cooling plate by positioning the cooling plate above the hot plate portion serving as the heating mechanism.

In the heat treatment method above, in another aspect, the step of heating the cooling plate with the heating mechanism includes the step of heating the cooling plate with the heating mechanism provided in the cooling plate.

Preferably, the heat treatment method above further includes the step of forcibly cooling the cooling plate.

In the heat treatment method above, preferably, the substrates include a first substrate and a second substrate treated next to the first substrate, and if a temperature for heat treatment of the second substrate by the hot plate portion is lower than that of the first substrate, the cooling plate is forcibly cooled by the time when the cooling plate receives the second substrate from the external transfer mechanism, after the first substrate is passed from the cooling plate to the external transfer mechanism.

In the heat treatment method above, preferably, the step of forcibly cooling the cooling plate includes the step of cooling the cooling plate by blowing a gas.

A recording medium according to the present invention is directed to a recording medium storing a computer program used in a heat treatment apparatus. The heat treatment apparatus includes a hot plate portion for subjecting a substrate to which a coating liquid is applied to heat treatment, a cooling plate for cooling the substrate, a drive mechanism for moving the cooling plate, and a heating mechanism for heating the cooling plate, and the computer program is configured to carry out the heat treatment method described above.

According to the present invention, in successively subjecting the substrates to heat treatment by using the heat treatment apparatus including the cooling plate, before the successive treatment, the cooling plate is heated to a cooling temperature of the substrate or to a temperature in the vicinity thereof, at which the temperature of the cooling plate is stabilized based on balance between heat absorption and heat dissipation therein during the successive treatment. Thus, the cooling temperatures after heat treatment of a plurality of substrates can be brought closer to each other and variation in heat treatment can be suppressed. In addition, a cooling mechanism for cooling the cooling plate, such as a Peltier element or a cooling pipe, can be dispensed with or simplified.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
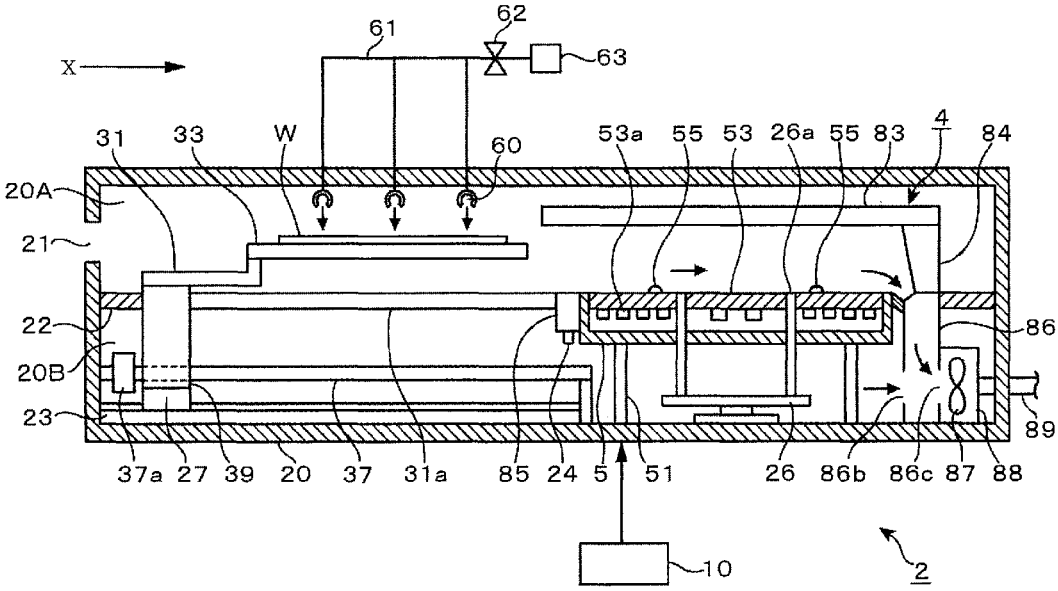
FIG. 1 is a vertical cross-sectional view illustrating an example of a heat treatment apparatus according to the present invention.

In the following, a heat treatment apparatus 2 for subjecting a semiconductor wafer (hereinafter, abbreviated as a wafer) W representing, for example, a substrate, to which surface a resist liquid as a coating liquid is applied, to heat treatment and forming a resist film on a surface of wafer W will be described as an exemplary heat treatment apparatus 2 for carrying out a heating method according to the present invention, with reference to FIGS. 1 to 3.

Heat treatment apparatus 2 includes a housing 20 representing a treatment chamber, and housing 20 is partitioned into an upper region 20A and a lower region 20B by a floor plate 22. A wafer W transfer port 21 is formed in a sidewall of upper region 20A. Assuming the side of transfer port 21 as the front, a cooling plate 33 is provided on the front side, and a hot plate portion 4 is provided on the rear side. Upper region 20A is a region where transfer, heat treatment, and cooling of wafer W is performed by cooling plate 33 and hot plate portion 4, and lower region 20B is a region where movable portions of cooling plate 33 and hot plate portion 4 as well as an exhaust fan 87 are accommodated. In floor plate 22, an opening portion 31*a* for movement of cooling plate 33 between the front side (a home position) and the rear side (a position above hot plate 53) in a direction of X in the drawing is provided.

A cooling gas discharge port 60 is provided above cooling plate 33 at the home position, and cooling gas discharge port 60 is connected to a cooling gas source 63 where $N_2$ gas or the like is stored, through a top wall of housing 20 via a cooling gas supply path 61 and a valve 62. Cooling gas discharge port 60 is provided at a plurality of locations, for example at five locations, so that entire cooling plate 33 at the home position is uniformly cooled. Cooling gas discharge port 60, cooling gas supply path 61, valve 62, and cooling gas source 63 constitute the cooling mechanism.

Figure 4:
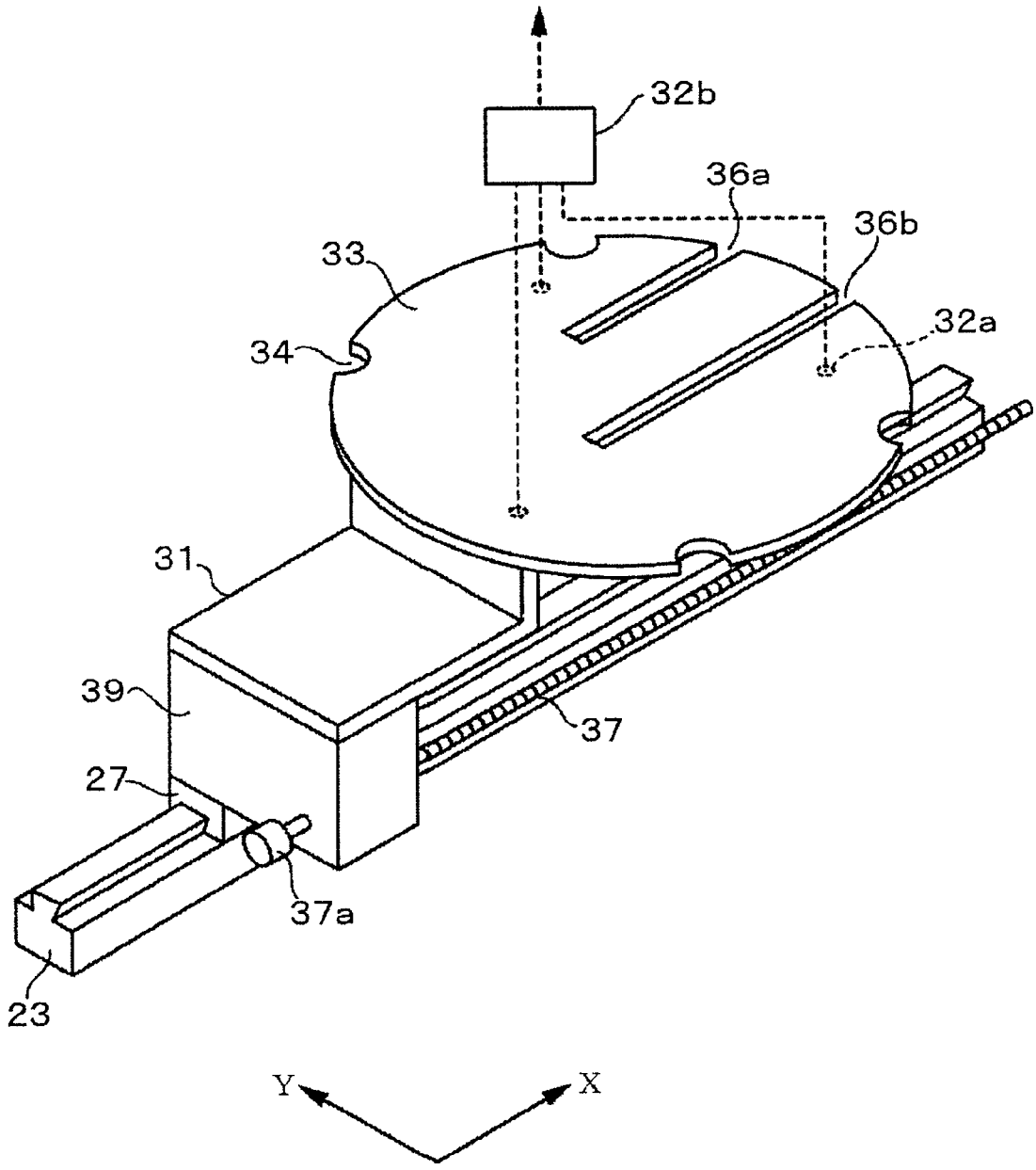
FIG. 4 illustrates an exemplary cooling plate 33 provided in the heat treatment apparatus.

Cooling plate 33 will now be described with reference to FIG. 4. Cooling plate 33 is connected to a base 39 with a coupling bracket 31 bent in L-shape being interposed, and cooling plate 33 serves to pass/receive wafer W to/from hot plate 53 which will be described later and a not-shown transfer mechanism provided outside heat treatment apparatus 2, and serves to cool wafer W after heat treatment. A rail bracket 27 and a cooling plate 33 moving mechanism such as a ball screw mechanism 37 and a motor 37*a* are provided in base 39, and cooling plate 33 can freely move in the direction of X through opening portion 31*a*, along a guide rail 23 extending in the direction of X in the drawing, by means of ball screw mechanism 37.

Cooling plate 33 is formed as a plate in a substantially annular shape, composed, for example, of aluminum, having a thickness of approximately 4 mm, and having a diameter substantially the same as wafer W. In cooling plate 33, in order to pass/receive wafer W to/from hot plate 53 and the not-shown transfer mechanism, a notch 34 and slits 36*a*, 36*b* are formed. In addition, in cooling plate 33, a temperature detection portion 32*a* is embedded, for example in three locations, at regular intervals along the circumferential direction of wafer W, so that the temperature of wafer W is detected by a temperature detector 32*b* and the detected temperature is transmitted to a control unit 10 which will be described later. Temperature detection portion 32*a* and temperature detector 32*b* constitute the temperature detection portion.

Figure 5:
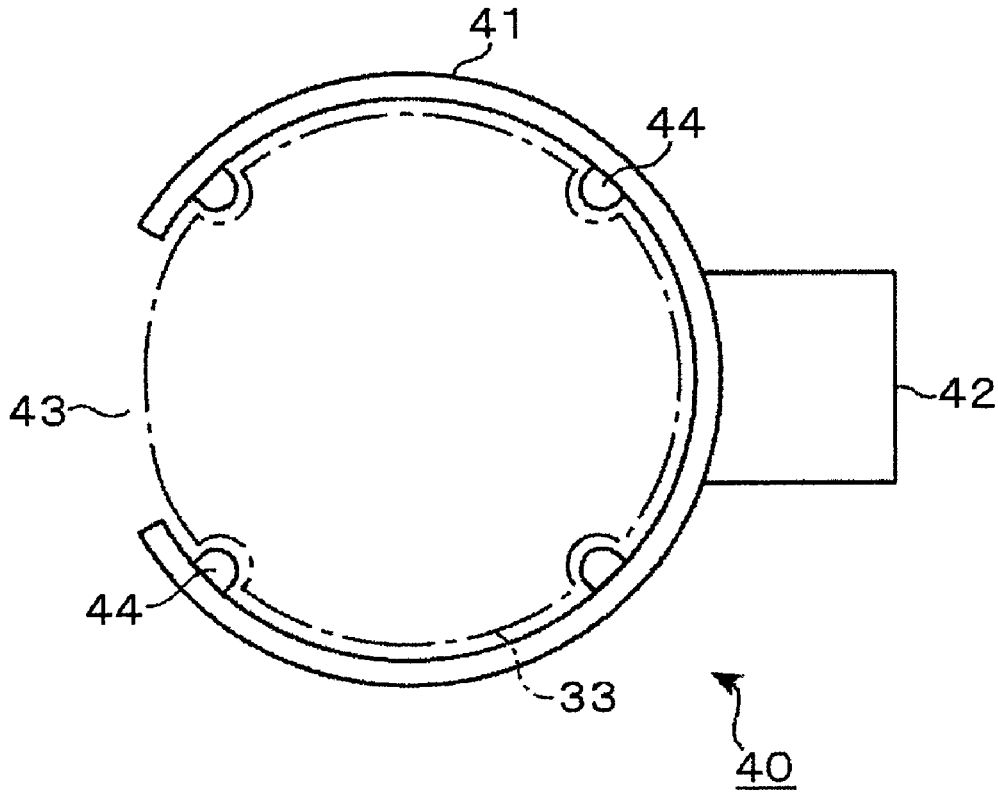
FIG. 5 illustrates a transfer mechanism 40 passing/receiving a wafer W to/from a temperature adjustment mechanism.

A transfer mechanism 40 passing/receiving wafer W to/from cooling plate 33 has a transfer arm 41 in a horseshoe shape extending horizontally and a transfer base 42 supporting transfer arm 41, for example as shown in FIG. 5. Four protrusions 44 are provided in the transfer arm, on which wafer W is held. Notches 34 on the outer circumference of cooling plate 33 are provided at positions corresponding to protrusions 44 of transfer arm 41, respectively. When transfer arm 41 lowers in such a manner as covering cooling plate 33 from above, transfer arm 41 passes through to the lower side of cooling plate 33 and wafer W on transfer arm 41 is placed on cooling plate 33.

Hot plate portion 4 will now be described. As shown in FIG. 1, hot plate portion 4 is provided between a gas discharge portion 85 and an exhaust chamber 86. In floor plate 22, a hot plate support member 5 supported by a strut 51 is embedded, and in the upper portion of hot plate support member 5, a projection 55 supporting the rear surface of wafer W is formed and hot plate 53 serving as a heating mechanism is provided. On the lower surface of hot plate 53, ring-shaped heaters 53*a* formed concentrically and a not-shown temperature-sensing sensor are provided, and an amount of heat generated by heater 53*a* is controlled through a not-shown power supply portion, based on an output from control unit 10 which will be described later.

A plurality of holes 54 are provided in the central portion of hot plate support member 5 and hot plate 53, so that wafer W can be passed between hot plate 53 and cooling plate 33 by means of a support pin 26*a* connected to a drive mechanism 26.

A top plate 83 is provided above hot plate support member 5 and top plate 83 is fixed to the upper surface of exhaust chamber 86 by a support portion 84, so that a flow of gas from the front to the rear between hot plate 53 and top plate 83 is straightened.

Exhaust chamber 86 including a plurality of exhaust holes 86*a* is provided in the rear of hot plate portion 4, and atmosphere in upper region 20A is exhausted outside housing 20 through exhaust chamber 86.

Opening portions 86*b* and 86*c* are formed on the front and rear sides in the central portion in a direction of width of exhaust chamber 86, and opening portion 86*c* is connected to a housing 88 that accommodates exhaust fan 87. One end side of an exhaust pipe 89 is connected to housing 88, and the other end of exhaust pipe 89 is connected, for example, to a not-shown factory exhaust path provided outside housing 20, through a wall surface of housing 20. Atmosphere in lower region 20B is exhausted outside housing 20 by exhaust fan 87 through exhaust chamber 86.

By forming such an airflow, vapor or the like of the solvent in the resist liquid applied to wafer W in upper region 20A and particles or the like generated from a movable portion of cooling plate 33 or hot plate portion 4 in lower region 20B are suctioned by exhaust fan 87 and exhausted outside housing 20.

A gas supply path 24 is connected in the central portion in the direction of Y of gas discharge portion 85 described previously, and gas supply path 24 is connected to a gas supply source 57*a* provided outside housing 20, through a wall surface of housing 20. Gas supply source 57*a* stores a clean purging gas, for example, an inert gas such as $N_2$ gas, so that heated hot plate 53 or wafer W can be cooled through gas discharge port 85*a* implemented by a plurality of small holes arranged along a direction of width of gas supply path 24 and gas discharge portion 85. The purging gas is exhausted outside housing 20 by means of exhaust fan 87 through exhaust chamber 86.

Figure 3:
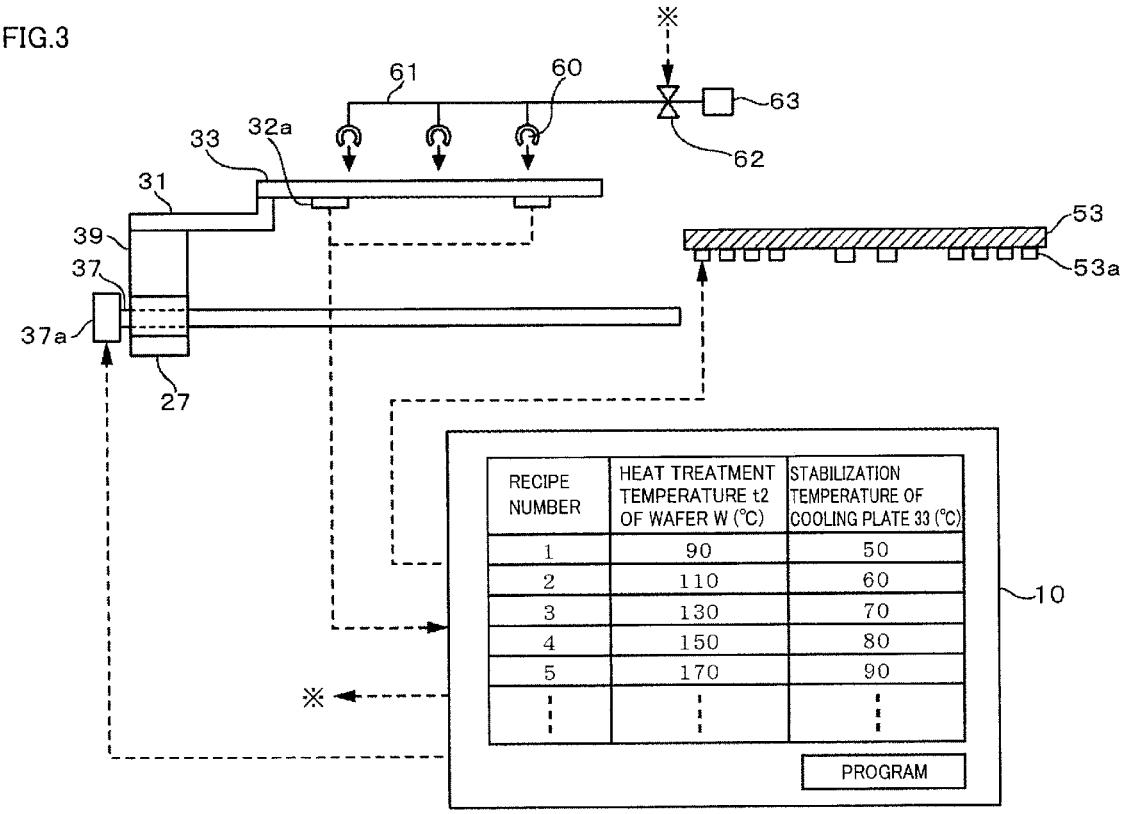
FIG. 3 illustrates a control unit 10 of the heat treatment apparatus.

As shown in FIG. 3, control unit 10 is configured, for example, with a computer, and control unit 10 stores a program and a table associating a heating temperature of wafer W and a stabilization temperature of cooling plate 33 with each other for each recipe. In the program, instructions to each portion in heat treatment apparatus 2 are configured such that temperature control of wafer W and cooling plate 33 in correspondence with each recipe (recipe number), delivery of wafer W, heat treatment of wafer W, or the like is carried out. When control unit 10 reads the program, control unit 10 outputs a signal for controlling heat treatment apparatus 2 which will be described later. It is noted that the program is stored in a recording medium such as a hard disk, a compact disc, a magneto-optical disc, a memory card, and the like.

Figure 6A:
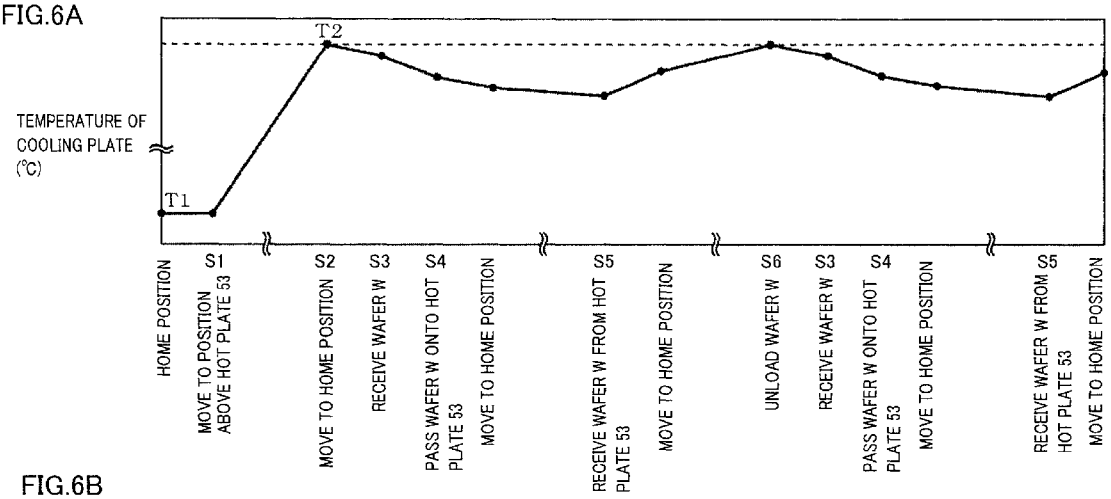
FIGS. 6A and 6B illustrate examples of transition of temperatures of cooling plate 33 and wafer W in a heat treatment method according to the present invention.
Figure 6B:
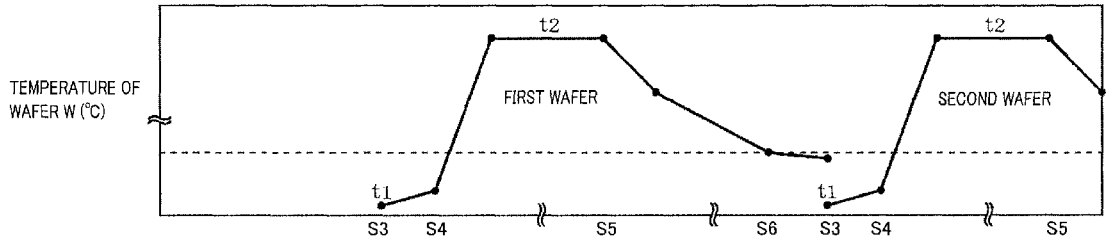
Figure 7:
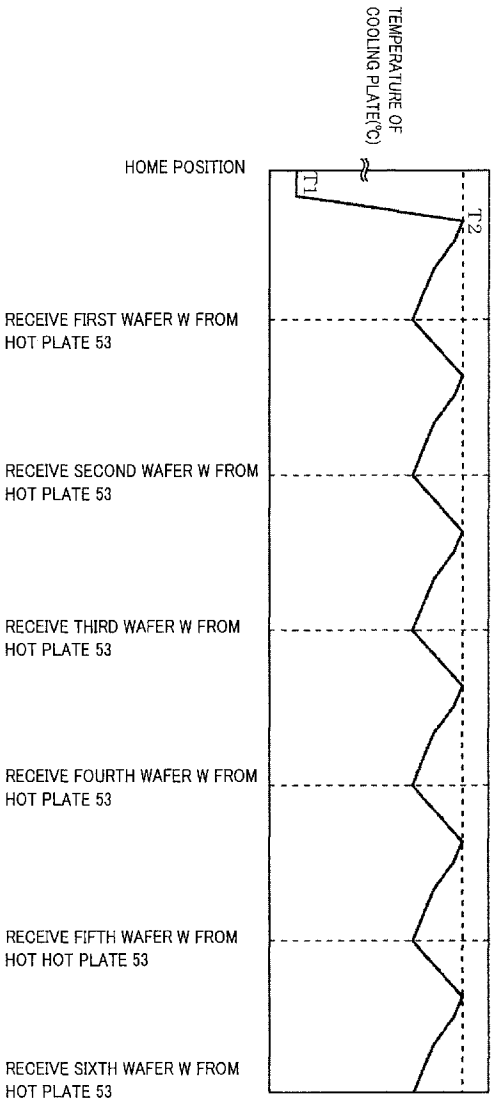
FIG. 7 illustrates an example of transition of a temperature of cooling plate 33 in the heat treatment method.

A heat treatment method in an embodiment of the present invention using heat treatment apparatus 2 will now be described with reference to FIGS. 6A, 6B and 7. The description will be given with reference to an example where power of heat treatment apparatus 2 is turned on and first wafer W is treated. Here, the surface of hot plate 53 is heated by heater 53*a* to a heat treatment temperature t2 of wafer W set in advance such as 110° C., and an initial temperature T1 of cooling plate 33 is set to 23° C., which is a room temperature.

Figure 2:
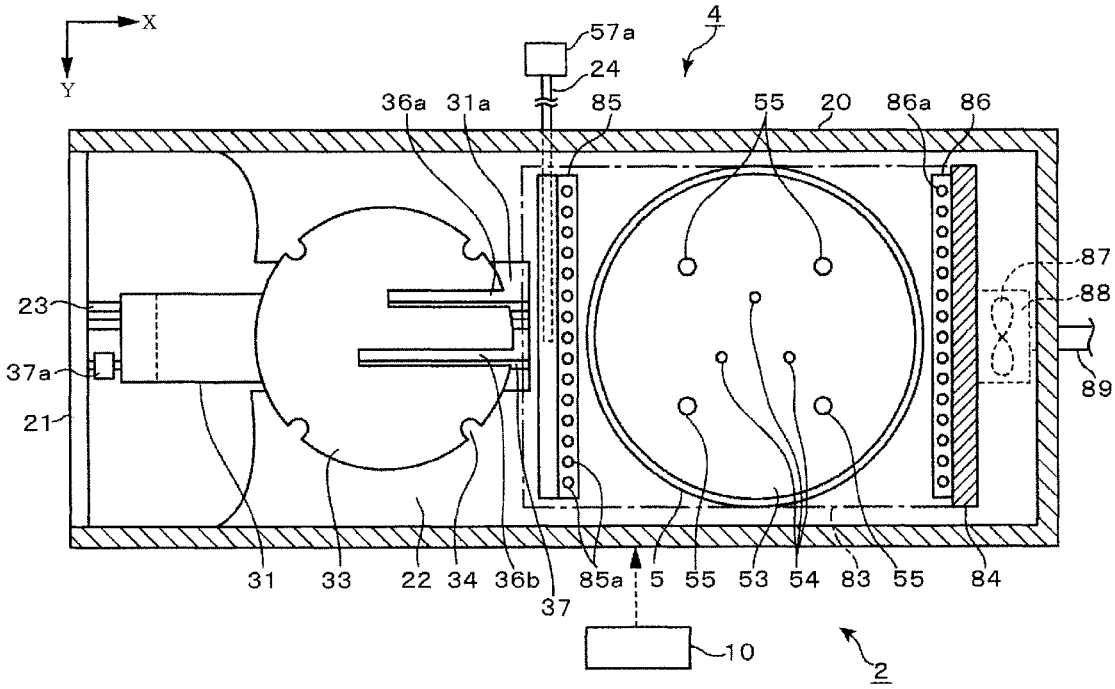
FIG. 2 is a cross-sectional plan view of the heat treatment apparatus.
Figure 8:
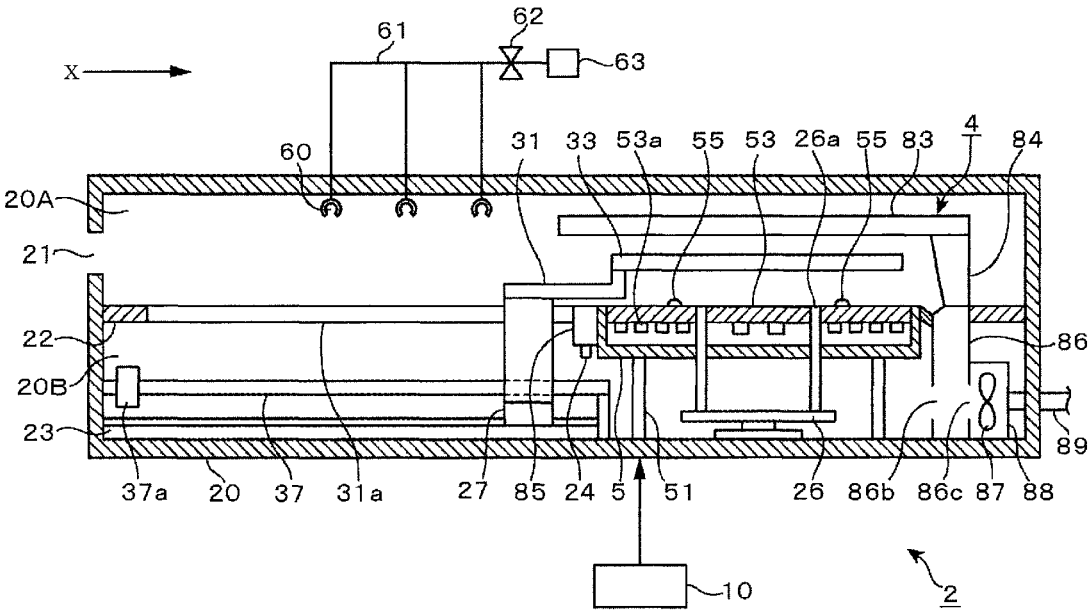
FIG. 8 illustrates an operation of cooling plate 33 in the heat treatment method.

Initially, cooling plate 33 moves from the home position shown in FIG. 1 (left end in the direction of X) to the position above hot plate 53 shown in FIG. 8 (right end in the direction of X) (step S1). Cooling plate 33 receives heat from hot plate 53 at the position above hot plate 53, stays until cooling plate 33 attains to a set temperature T2 such as 60° C., and thereafter returns again to the home position (step S2). The set temperature T2 refers to a temperature at which cooling plate 33 is subjected to heat treatment by hot plate 53, and to a temperature at which a temperature of cooling plate 33 raised as a result of reception and accumulation of heat at the time of reception of wafer W and a temperature that is lowered due to natural heat dissipation are substantially stabilized in a successive treatment cycle.

Meanwhile, first wafer W to which surface a resist liquid is applied and of which initial temperature t1 is set, for example, to room temperature of 23° C. is loaded into housing 20 through transfer port 21 by transfer mechanism 40 described already, and placed on cooling plate 33 as described already (step S3). Then, transfer mechanism 40 exits from housing 20.

The timing at which cooling plate 33 returns to the home position in step S2 is set to timing immediately before first wafer W in the successive treatment is placed on cooling plate 33. Therefore, actually, for example, cooling plate 33 may be controlled such that cooling plate 33 moves to a position above hot plate 53 at the time of turn-on of the coating and development apparatus, returns to the home position as soon as temperature is raised to set temperature T2, again moves to the position above hot plate 53 for compensating for slight heat loss slightly before loading of first wafer W, returns to the home position after set temperature T2 is attained, and receives first wafer W.

Then, when cooling plate 33 moves to the position above hot plate 53, support pin 26*a* is elevated and supports the rear surface of wafer W placed on cooling plate 33. When cooling plate 33 returns to the home position, support pin 26*a* lowers, and wafer W is placed on projection 55 of hot plate 53. Thereafter, wafer W is heated to heat treatment temperature t2 such as 110° C. and held for a period set in advance, such as 60 seconds, for heat treatment (step S4).

Thereafter, support pin 26*a* is elevated and supports wafer W. In succession, cooling plate 33 again moves from the home position to the position above hot plate 53, wafer W is placed on cooling plate 33 of which temperature has attained, for example to 50° C., and the heat is transmitted to cooling plate 33 (step S5).

Thereafter, cooling plate 33 returns to the home position. Then, transfer mechanism 40 described already comes to receive wafer W at regular time intervals. Here, wafer W is cooled by cooling plate 33 until reception, for example for 30 seconds, and the temperature of cooling plate 33 and the temperature of wafer W both attain, for example, to 60° C.

Thereafter, transfer mechanism 40 enters housing 20 through transfer port 21, receives wafer W on cooling plate 33, and transfers wafer W out of housing 20 (step S6). Thereafter, transfer mechanism 40 transfers subsequent wafer W (second wafer in this example) into housing 20, and step S3 to step S6 are repeated.

As will be described later, transfer mechanism 40 includes two arms. Transfer mechanism 40 receives wafer W that has been subjected to heat treatment from cooling plate 33 and immediately thereafter passes wafer W to be treated to cooling plate 33. Here, time interval for transferring wafer W is constant, because it is scheduled transfer. In the subsequent successive treatment, as shown in FIG. 7, in cooling plate 33, the amount of heat absorbed from wafer W and an amount of heat dissipated to wafer W or to ambient atmosphere are balanced. Therefore, the temperature of cooling plate 33 immediately after unloading of wafer W (step S6) is stabilized for example at 60° C. for each treatment of wafer W. In addition, as the amount of heat absorbed in wafer W from hot plate portion 4 or cooling plate 33 and the amount of heat dissipated therefrom during cooling are substantially the same among wafers W, the temperature of wafer W after cooling (step S6) is stabilized, for example, at 60° C.

As described above, after a prescribed number of wafers W in one lot (one unit) are subjected to successive treatment, successive treatment of wafers W in next lot is performed.

An example in which wafers W are successively subjected to heat treatment and thereafter heat treatment is continued with varied heat treatment temperature t2 of wafer W will now be described.

Initially, in varying heat treatment temperature t2 of wafer W, set temperature T2 of cooling plate 33 in accordance with the recipe to be applied to the next lot is read from a memory unit in control unit 10, and cooling plate 33 is heated or cooled until the temperature value detected by the temperature detection portion of cooling plate 33 attains to set temperature T2. If heat treatment temperature t2 of wafer W is set to a temperature higher than before, the stabilization temperature of cooling plate 33 is raised as shown in the experiment example which will be described later. Accordingly, cooling plate 33 is positioned above hot plate 53 and heated until the detected temperature value attains to set temperature T2. Meanwhile, if heat treatment temperature t2 is set to a temperature lower than before, the stabilization temperature of cooling plate 33 is lowered. Here, cooling plate 33 should be cooled in order to avoid lowering in throughput. Such an example will be described with reference to FIG. 9.

Figure 9:
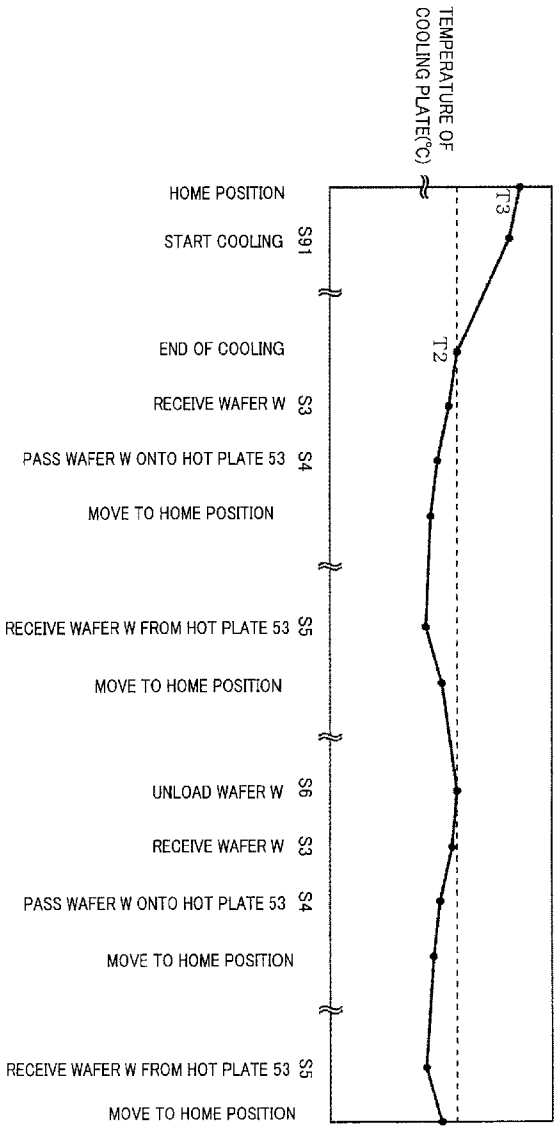
FIG. 9 illustrates an example of transition of a temperature of cooling plate 33 in the heat treatment method.

Cooling plate 33 is at high initial temperature T3 such as 80° C. at the home position shown at the left end in FIG. 9, as a result of heat treatment of wafer W so far. Thereafter, in step S91, cooling plate 33 is blown with a cooling gas such as $N_2$ gas supplied from cooling gas source 63 through valve 62, cooling gas supply path 61 and cooling gas discharge port 60, and cooling plate 33 is cooled until the detected temperature value attains to set temperature T2 such as 60° C.

Then, as described previously, heat treatment and cooling of wafer W is performed, and thereafter successive heat treatment of second and subsequent wafers W is performed.

By the method above, as temperature of cooling plate 33 can quickly be lowered from high initial temperature T3 to set temperature T2 in step S91, heat treatment can be performed without reducing an operating time of heat treatment apparatus 2.

After successive treatment of one lot ends and heat treatment temperature t2 of wafer W is changed by using the method described above, if time interval until loading into housing 20 of wafer W in the next lot is long enough for the temperature of cooling plate 33 to lower, cooling plate 33 may move to the position above hot plate 53 for compensation of heat loss, as in the case of turn-on of power of the coating and development apparatus described already.

According to heat treatment apparatus 2 of the present invention, in successively subjecting wafers W to heat treatment, before the successive treatment, cooling plate 33 is heated in advance by hot plate 53 so that the temperature of cooling plate 33 is adjusted to set temperature T2 at which the temperature of cooling plate 33 is stabilized based on balance between heat absorption and heat dissipation therein during the successive treatment. Thus, the temperature of wafer W when it is unloaded from housing 20 (step S6) is uniform among wafers W. Therefore, variation in heat treatment among wafers W can be suppressed, and for example, variation in the thickness of the resist film or in the line width of the pattern can be lowered.

In the present embodiment, it is not necessary to provide a cooling mechanism such as a cooling pipe or a Peltier element in cooling plate 33, for the following reasons. Specifically, if heated wafer W is cooled by using cooling plate 33 so as to reduce the time for cooling, heat dissipation does not proceed fast enough relative to heat absorption from wafer W unless high cooling capability is ensured. Consequently, the cooling temperature (the temperature to which wafer W is cooled by cooling plate 33) is successively increased until several wafers W are treated after the start of successive treatment. Meanwhile, the present inventors have found that, if cooling to a temperature half the heated temperature can be attained in spite of the cooling temperature being higher than in the conventional example, finishing of the treatment of wafer W, such as the line width of the pattern, is not affected. In contrast, if there is variation in the cooling temperature among wafers W in the lot, variation in finishing of wafer W is caused, which results in lower yield. Therefore, turning to the concept to attain the cooling temperature at substantially the same level among wafers W rather than to the cooling temperature itself, such a method as finding in advance a temperature of the cooling plate, at which cooling temperatures are substantially the same among all wafers W to be subjected to successive treatment, and raising in advance the temperature of cooling plate 33 to that temperature has been adopted. Accordingly, a design without requiring great cooling capability and without a cooling mechanism in cooling plate 33 as in the present embodiment can be adopted. Thus, smaller size and lighter weight of the apparatus can be achieved, and in addition, accidents in electric system, e.g., due to leakage of a coolant, or lower quality such as generation of particles in wafer W can be suppressed.

In the embodiment described above, the temperature of cooling plate 33 is adjusted in advance such that first wafer W and second wafer W in the lot are cooled to the same temperature, however, the present invention is not limited to an example where "the same temperature is attained." Namely, the present invention aims to suppress non-uniformess in heat treatment among wafers to thereby improve yield, by heating cooling plate 33 so that difference in the cooling temperature of wafer W between first wafer W and next wafer W in the lot is made smaller even though cooling plate 33 has low cooling capability. In other words, attention being paid to "the same temperature," the present invention aims to decrease the number of wafers W to be treated until "the same temperature" is attained in successive treatment of wafers W under the same condition. Thus, even though the cooling temperature is not the same, first wafer W and second wafer W attain to temperatures close to each other, and the heat treatment finishing state can be uniform from the first wafer in the lot, without high cooling capability, for example without a cooling mechanism. Therefore, the effect above can be obtained even if the cooling temperature of second wafer W is higher than that of first wafer W, for example, by 10° C.

As a method of heating cooling plate 33, in the present embodiment, before cooling of wafer W, hot plate 53 is used as the heating mechanism, and cooling plate 33 is then moved to the position above hot plate 53 so as to receive heat from hot plate 53. The present embodiment, however, is not limited to such a method, and for example, a heater or the like serving as the heating mechanism may be embedded in cooling plate 33. Such an example will now be described with reference to FIGS. 10 and 11.

Figure 10:
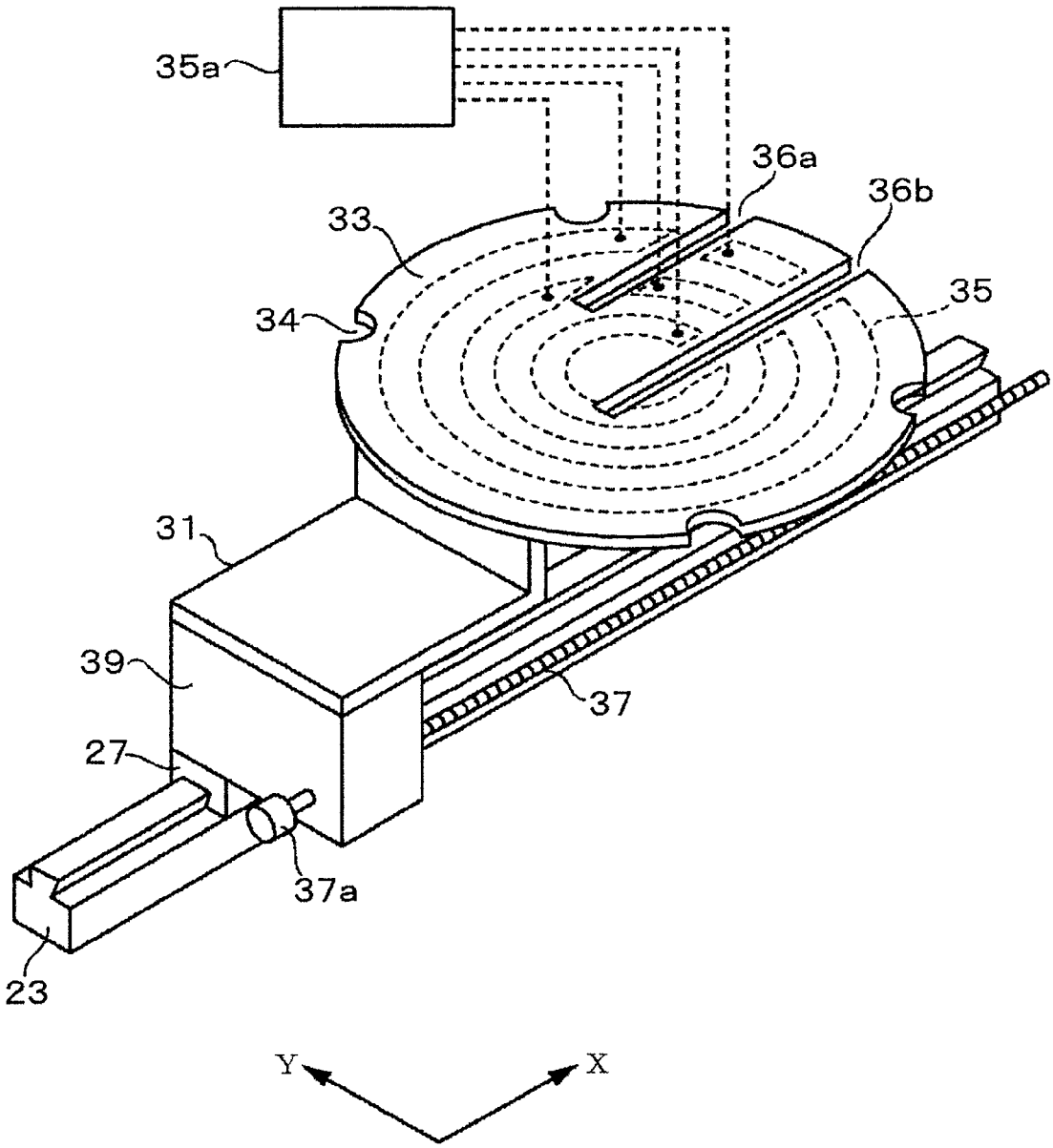
FIG. 10 illustrates exemplary cooling plate 33.

In cooling plate 33 in FIG. 10, ring-shaped heaters 35 serving as the heating mechanism are embedded, for example, in quintuple, and each heater 35 is connected to a power supply 35*a* for heating cooling plate 33. It is noted that FIG. 10 does not show temperature detection portion 32*a* and temperature detector 32*b* described already.

Figure 11:
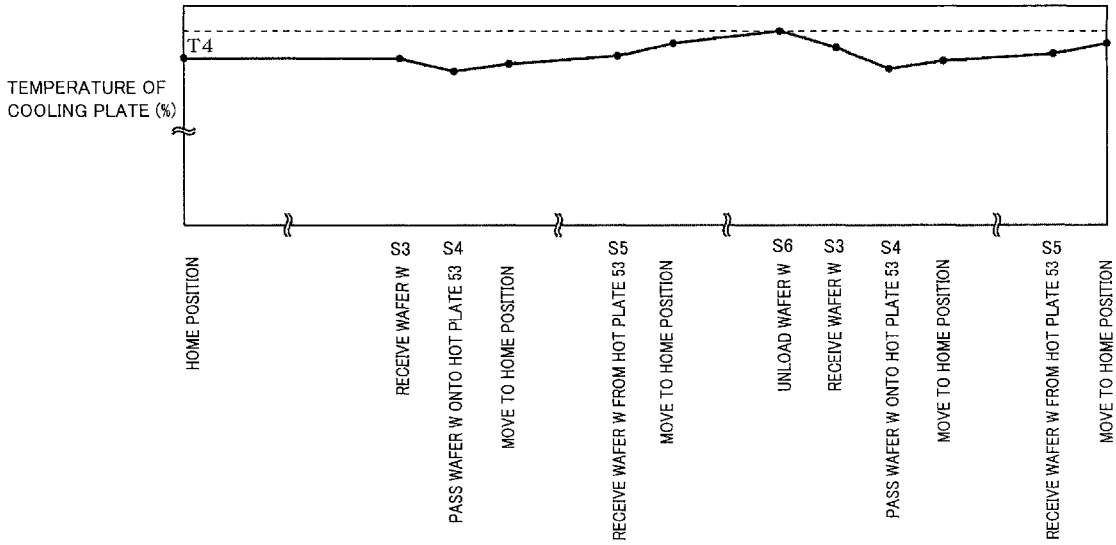
FIG. 11 illustrates an example of transition of a temperature of cooling plate 33 in the heat treatment method.

At the time of turn-on of power of heat treatment apparatus 2 described already, the surface of hot plate 53 is heated by heater 53*a* to heat treatment temperature t2 set in advance, such as 110° C. In addition, as shown in FIG. 11, cooling plate 33 is held in advance at a set temperature T4 such as 55° C.

In the present example, wafer W is received from transfer mechanism 40 (step S3) without performing step S1 and step S2 described already. Thereafter, as in the example described above, heat treatment and cooling in the successive treatment of wafer W is performed.

As described above, by embedding heater 35 in cooling plate 33, the time for adjusting the temperature of cooling plate 33 to set temperature T2 (the time from step S1 to step S2 described already) can be shortened. In addition, as the temperature of cooling plate 33 can be adjusted with high accuracy in order to make the temperature of wafers W more uniform at the time of unloading of wafer W, temperature difference between wafers W is less likely. It is noted that temperature adjustment by heating of cooling plate 33 by heater 35 may performed, for example, on the first to fourth wafers W in the lot, and thereafter heating control output to heater 35 may be turned off.

In addition, in the example described above, as the method of cooling cooling plate 33 at the time of switching of the lots, cooling is carried out in such a manner that cooling gas discharge port 60, cooling gas supply path 61, valve 62, and cooling gas source 63 are used as the cooling mechanism and cooling plate 33 is blown with a cooling gas, however, the following structure may be adopted.

Figure 12:
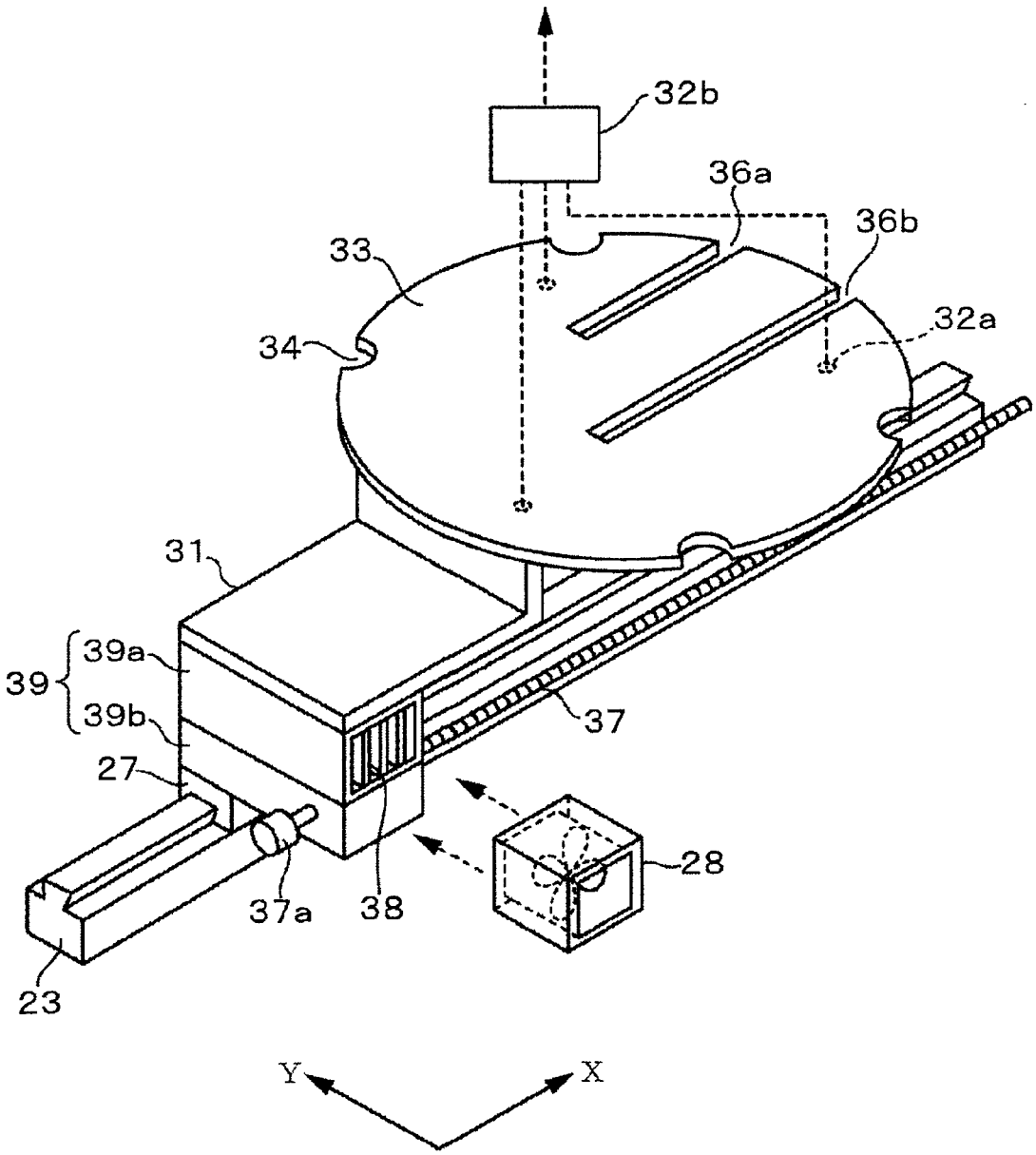
FIG. 12 illustrates exemplary cooling plate 33.

FIG. 12 shows exemplary cooling plate 33, and base 39 described already consists of an upper chamber 39*a* and a lower chamber 39*b*. Upper chamber 39*a* is formed by a hollow parallelepiped member of which side surfaces in the direction of Y are open, and for example, 10 vertical fins 38 that are formed, for example, from aluminum are provided inside in the direction of Y. Fin 38 serves to quickly dissipate heat of cooling plate 33 through the top wall of upper chamber 39*a* and coupling bracket 31. As described already, ball screw mechanism 37, motor 37*a*, and rail bracket 27 are provided in lower chamber 39*b*.

Upper chamber 39*a* is structured such that a fan 28 serving as the cooling mechanism is connected to one opening and fan 28 is driven with electric power from a not-shown power supply, thereby sending air into upper chamber 39*a*. As fin 38 is cooled by the air sent into upper chamber 39*a*, cooling plate 33 can quickly be cooled through the top wall of upper chamber 39*a* and coupling bracket 31.

EXPERIMENT EXAMPLE

An experiment conducted in order to confirm how the stabilization temperature of cooling plate 33 varies depending on heat treatment temperature t2 of wafer W will now be described.

In the experiment, heat treatment apparatus 2 described already was used and the experiment was conducted under the following process conditions. Under each condition, 25 wafers W were subjected to successive heat treatment. Meanwhile, heating of cooling plate 33 at the time of turn-on of power of heat treatment apparatus 2 described already (step S1 to step S2) was not conducted.

Process Conditions

Temperature T1 of cooling plate 33: 23° C.

Temperature t1 of wafer W: 23° C.

Heat treatment temperature t2 of wafer W: separately shown

Heat treatment time period of wafer W: 60 seconds

Cooling time period of wafer W: 30 seconds

Experiment Example 1

Heat treatment temperature t2 of wafer W was set to 90° C.

Experiment Example 2

Heat treatment temperature t2 of wafer W was set to 110° C.

Experiment Example 3

Heat treatment temperature t2 of wafer W was set to 130° C.

Experiment Example 4

Heat treatment temperature t2 of wafer W was set to 150° C.

Experiment Example 5

Heat treatment temperature t2 of wafer W was set to 170° C.

Result of Experiment

Figure 13:
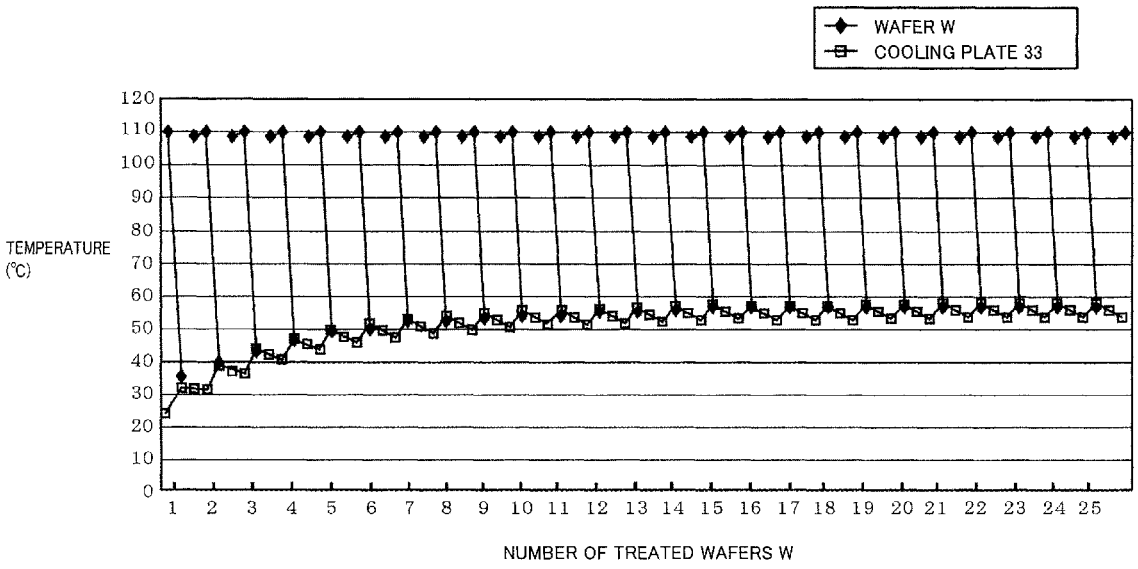
FIG. 13 illustrates a result of experiment in the present invention.

In Experiment Example 2, a terminal for measuring a temperature was connected to wafer W. The temperature of cooling plate 33 and wafer W was measured when the temperature of wafer W attained to 110° C. (step S4), when cooling of wafer W was started (step S5), and when wafer W was unloaded from housing 20 (step S6), and FIG. 13 shows the result of measurement.

In addition, Table 1 shows heat treatment temperature t2 of wafer W and the stabilization temperature of cooling plate 33 in each experiment example.

TABLE 1

| Experiment Example No. | Heat Treatment Temperature t2 of Wafer W (° C.) | Stabilization Temperature of Cooling Plate 33 (° C.) |
|---|---|---|
| 1 | 90 | 50 |
| 2 | 110 | 60 |
| 3 | 130 | 70 |
| 4 | 150 | 80 |
| 5 | 170 | 90 |

It can be seen from FIG. 13 that, by successively subjecting wafers W to heat treatment, as described already, the temperature of cooling plate 33 when wafer W was unloaded from housing 20 (step S6) gradually stabilized and approached 60° C. Thus, it was found that, in successive treatment of wafer W, before heat treatment of first wafer W, set temperature T2 of cooling plate 33 should advantageously be set to 60° C.

In addition, as to the stabilization temperature of cooling plate 33, it can be seen as shown in Table 1 that as heat treatment temperature t2 of wafer W was higher, the stabilization temperature of cooling plate 33 (cooling temperature of wafer W) was higher.

It is noted that, for example, heat treatment temperature t2 of wafer W in a range from 90° C. to 130° C. refers to a temperature range used for a process for drying the solvent in the resist liquid, and for example, heat treatment temperature t2 of wafer W in a range from 130° C. to 170° C. refers to a temperature range used for a process for heat treatment of exposed wafer W. Accordingly, it was found that the temperature difference between set temperature T2 and temperature T3 of cooling plate 33 that should be changed at the time of change in heat treatment temperature t2 of wafer W in each process is within a range of 20° C. at the maximum.

Figure 14:
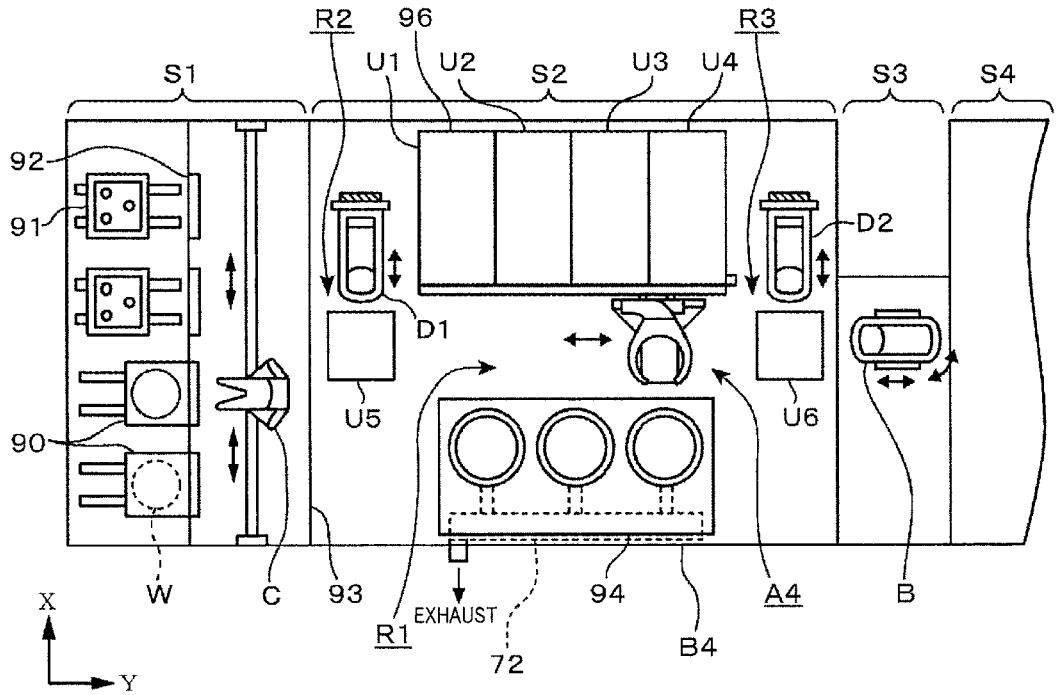
FIG. 14 is a plan view of a coating and development apparatus to which the heat treatment apparatus is applied.
Figure 15:
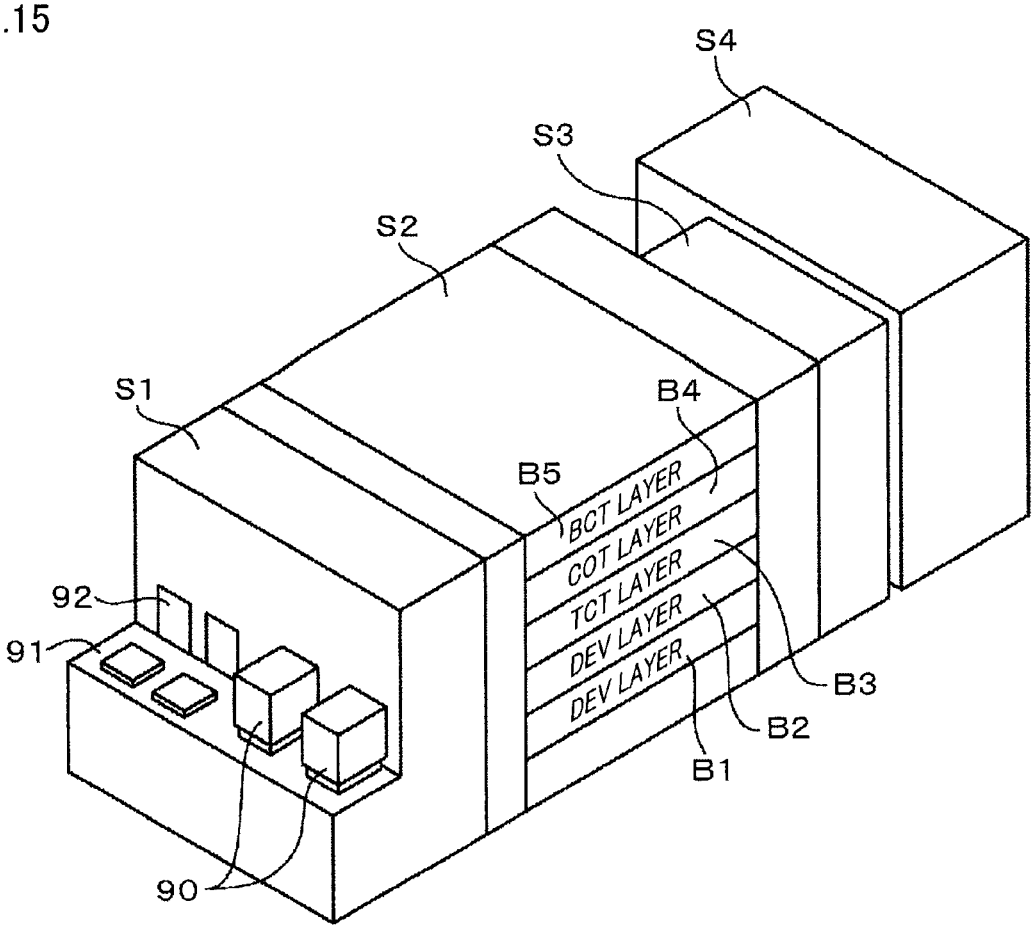
FIG. 15 is a perspective view of the coating and development apparatus.
Figure 16:
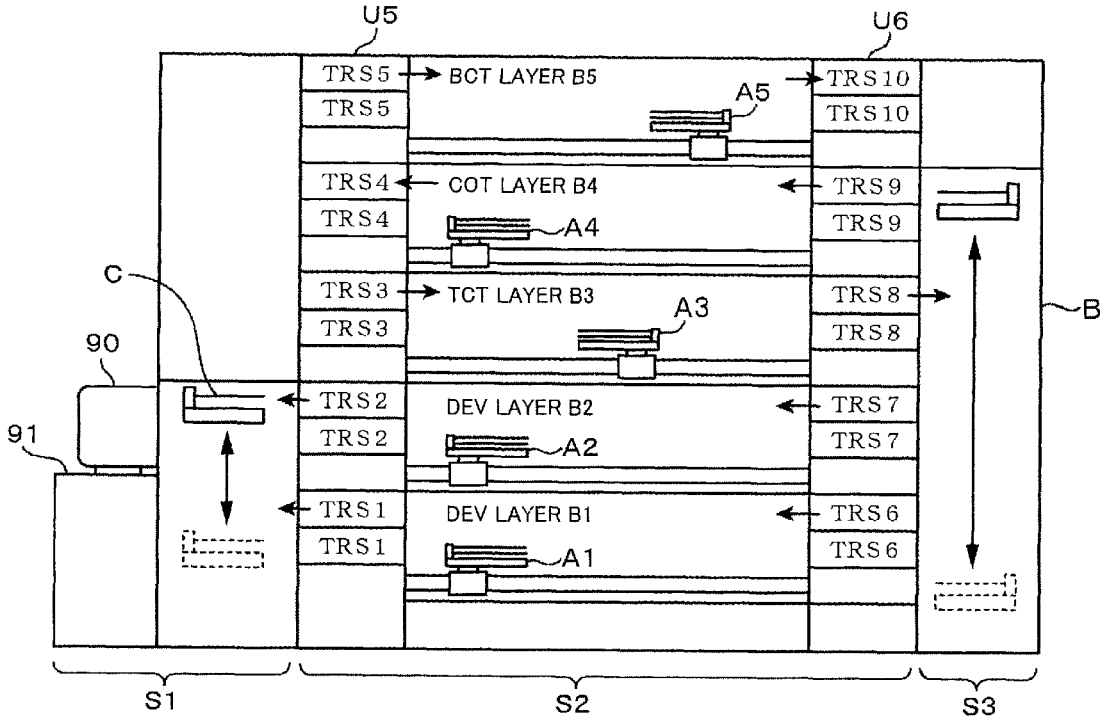
FIG. 16 is a cross-sectional side view of the coating and development apparatus.
Figure 17:
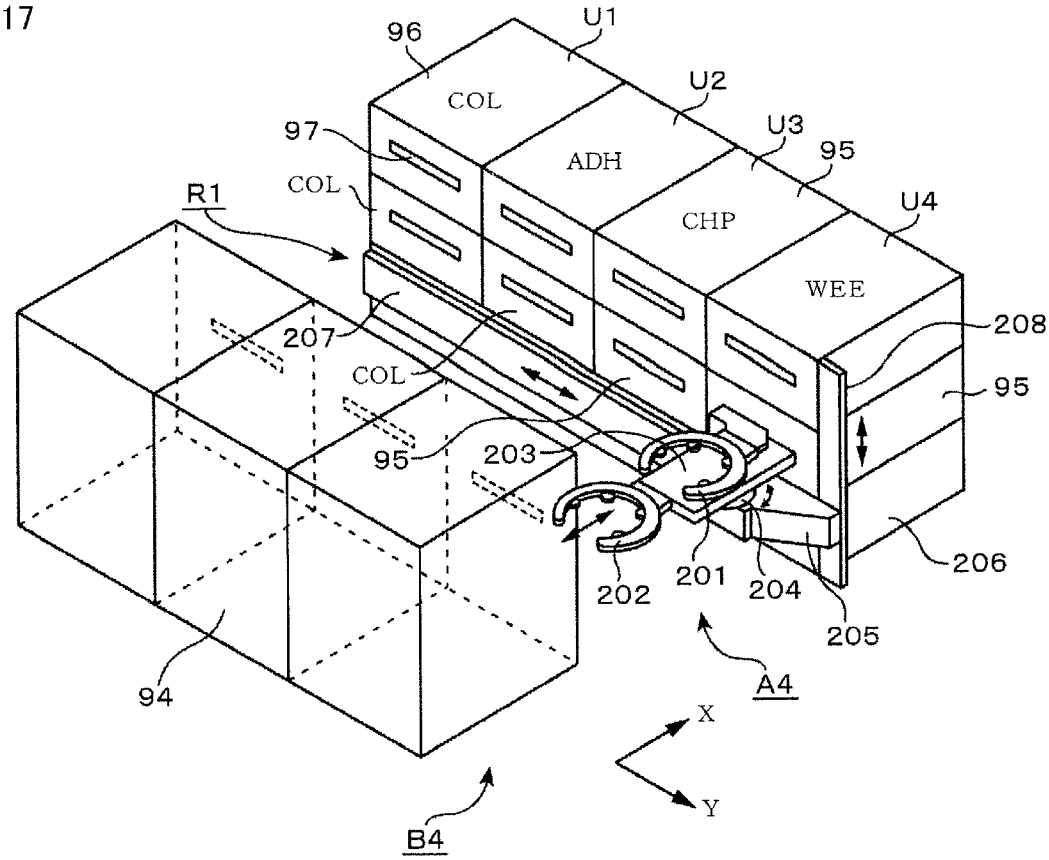
FIG. 17 is a perspective view of a coating unit, a shelf unit, and transfer means in the coating and development apparatus.
Figure 18:
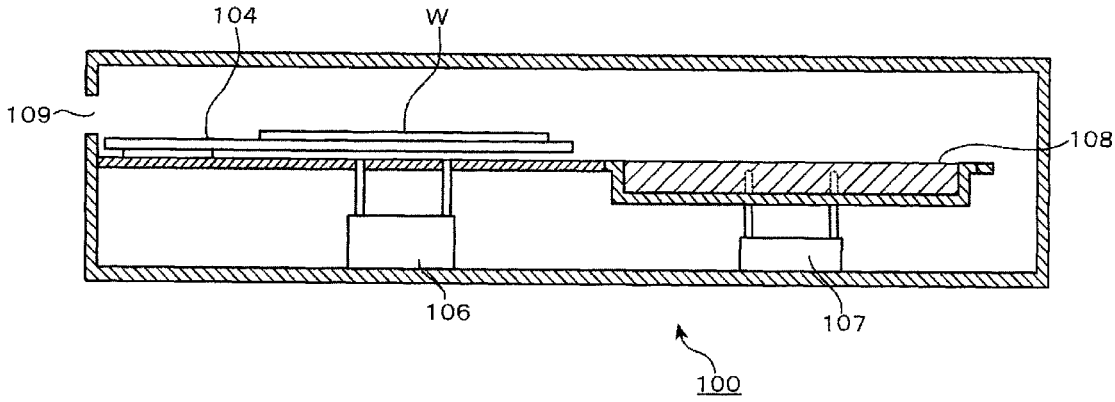
FIG.18 PRIOR ART
FIG. 18 illustrates a conventional heat treatment apparatus.

In succession, one embodiment where heat treatment apparatus 2 described already is applied to the coating and development apparatus will be described. FIG. 14 is a plan view of a resist pattern forming apparatus, FIG. 15 is a schematic perspective view thereof, FIG. 16 is a schematic side view thereof, and FIG. 17 is a perspective view showing a structure around a transfer region R1 provided in the resist pattern forming apparatus. The apparatus includes a carrier block S1 for loading/unloading a carrier 90 accommodating, for example, 13 wafers W serving as substrates in a sealed manner, a treatment block S2 structured by vertically arranging a plurality of unit blocks, for example 5 unit blocks B1 to B5, an interface block S3, and an exposure apparatus S4.

In carrier block S1, a carrier base 91 for carrier 90, an opening/closing portion 92 provided in a wall surface, a transfer arm C for taking wafer W out of carrier 90 through opening/closing portion 92 are provided.

Treatment block S2 surrounded by a housing 93 is connected to the rear side of carrier block S1. In treatment block S2, in this example, first and second unit blocks (DEV layer) B1, B2 for development treatment arranged in two lowest layers, a third unit block (TCT layer) B3 for performing treatment for forming an antireflection coating on the upper layer side of the resist film, a fourth unit block (COT layer) B4 for performing treatment for applying the resist liquid, and a fifth unit block (BCT layer) B5 for performing treatment for forming an antireflection coating on the lower layer side of the resist film are allocated.

Each of these unit blocks B1 to B5 includes a liquid treatment unit for applying a chemical to wafer W, various heating/cooling treatment units for pre-treatment and post-treatment for the treatment performed in the liquid treatment unit, and main arms A1 to A5 serving as the transfer mechanism dedicated for passing/receiving wafer W to/from the heating/cooling treatment units in the apparatus. Transfer mechanism 40 described already represents main arms A1 to A5.

As each layer B1 to B5 is structured substantially similarly, COT layer B4 shown in FIG. 14 will be described as representative. On opposing sides of transfer region R1 of wafer W, a coating unit 94 including a plurality of coating portions for treatment for applying a resist to wafer W and four shelf units U1, U2, U3, and U4 structured by arranging heating/cooling units in multiple layers are provided. Each of shelf units U1 to U4 is structured in such a manner that various units for pre-treatment and post-treatment for the treatment performed in coating unit 94 are stacked in multiple layers, for example, in two layers.

Various units for pre-treatment and post-treatment described above include, for example, a cooling unit (COL) for adjusting a temperature of wafer W to a prescribed temperature before application of the resist liquid, a heating unit (CHP) 95 called, for example, a pre-baking unit, for heat treatment of wafer W after application of the resist liquid, an edge exposure apparatus (WEE) for selectively exposing only an edge portion of wafer W, and the like. In this embodiment, heat treatment apparatus 2 described in connection with FIGS. 1 to 13 corresponds to heating unit 95. In addition, each treatment unit such as the cooling unit (COL) and heating unit (CHP) 95 is accommodated in a treatment chamber 96, shelf units U1 to U4 are structured by stacking treatment chamber 96 in two layers, and a transfer port 97 for loading/unloading wafer W is formed in a surface facing transfer region R1 of each treatment chamber 96. In this example, heating unit (CHP) 95 is stacked as shelf unit U3 and included in shelf unit U4.

Main arm A4 includes two arms that can be driven independently, and it is structured so as to be capable of movement forward/backward, movement upward/downward, pivot around a vertical axis, and movement in the direction of Y. FIG. 17 shows transfer arms 201, 202, a transfer base 203, a rotation mechanism 204 for rotating transfer base 203, a base portion 205 capable of movement along a Y rail 207 and movement upward/downward along a rail 208, and a base portion 206 supporting shelf units U1 to U4.

The region adjacent to carrier block S1 of transfer region R1 serves as a first wafer W delivery region R2. In region R2, as shown in FIGS. 14 and 16, a shelf unit U5 is provided at a position allowing access by transfer arm C and main arm A4, and a first delivery arm D1 serving as a first substrate delivery mechanism for delivering wafer W to shelf unit U5 is provided.

As shown in FIG. 16, shelf unit U5 is structured to pass/receive wafer W to/from main arms A1 to A5 of respective unit blocks B1 to B5. Unit blocks B1 to B5 in this example include at least one, for example two first delivery stages TRS1 to TRS5.

The region adjacent to interface block S3 of transfer region R1 serves as a second wafer W delivery region R3. In region R3, as shown in FIG. 14, a shelf unit U6 is provided at a position allowing access by main arm A4, and a second delivery arm D2 serving as a second substrate delivery mechanism for delivering wafer W to shelf unit U6 is provided.

As shown in FIG. 16, shelf unit U6 includes second delivery stages TRS6 to TRS10 for passing/receiving wafer W to/from main arms A1 to A5 of respective unit blocks B1 to B5.

As to other unit blocks, DEV layers B1 and B2 are structured similarly. A development unit including a plurality of development portions for development treatment of wafer W is provided. Shelf units U1 to U4 are structured similarly to COT layer B4 except for including a heating unit (PEB) called, for example, a post-exposure baking unit for heat treatment of exposed wafer W, a cooling unit (COL) for adjusting a temperature of wafer W to a prescribed temperature after treatment in the heating unit (PEB), and a heating unit (POST) called, for example, a post-baking unit for heat treatment of wafer W after development treatment for removal of moisture. These heating units provided in DEV layers B1 and B2 are structured, for example, in a manner the same as heating unit 95 provided in COT layer B4, and they are different from heating unit 95 only in the temperature and time for treatment.

In addition, in TCT layer B3, an antireflection coating forming unit for applying a chemical for forming antireflection coating to wafer W before application of the resist liquid is provided.

Meanwhile, exposure apparatus S4 is connected to the rear side of shelf unit U6 in treatment block S2, with interface block S3 being interposed. Interface block S3 includes an interface arm B for passing/receiving wafer W to/from shelf unit U6 in treatment block S2 and exposure apparatus S4, and interface block S3 is structured to pass/receive wafer W to/from second delivery stages TRS6 to TRS9 in respective first to fourth unit blocks B1 to B4.

Here, the flow of wafer W in the resist pattern forming apparatus will be described with reference to an example where antireflection coatings are formed on and under the resist film. Initially, carrier 90 is loaded from the outside into carrier block S1, and wafer W is taken out of carrier 90 by transfer arm C through opening/closing portion 92. Wafer W is initially passed from transfer arm C to first delivery stage TRS2 of shelf unit U5 in second unit block B2, and thereafter, for delivery of wafer W to BCT layer B5, wafer W is passed to main arm A5 of BCT layer B5 by first delivery arm D1 through first delivery portion TRS5. Then, in BCT layer B5, main arm A5 transfers wafer W in the order of the cooling unit (COL), the first antireflection coating forming unit, the heating unit (CHP), and second delivery stage TRS10 of shelf unit U6, thereby forming the first antireflection coating.

In succession, wafer W in second delivery stage TRS10 is transferred to second delivery stage TRS9 by second delivery arm D2, for delivery of wafer W to COT layer B4, and thereafter passed to main arm A4 of COT layer B4. Then, in COT layer B4, main arm A4 transfers wafer W in the order of the cooling unit (COL), coating unit 94, heating unit (CHP) 95, and first delivery stage TRS4, thereby forming the resist film on the first antireflection coating.

Thereafter, wafer W in delivery stage TRS4 is transferred to first delivery stage TRS3 by first delivery arm D1, for delivery of wafer W to TCT layer B3, and passed to main arm A3 of TCT layer B3. Then, in TCT layer B3, main arm A3 transfers wafer W in the order of the cooling unit (COL), the second antireflection coating forming unit, the heating unit (CHP), the edge exposure apparatus (WEE), and second delivery stage TRS8 of shelf unit U6, thereby forming the second antireflection coating on the resist film.

In succession, wafer W in second delivery stage TRS8 is transferred to exposure apparatus S4 by interface arm B, where prescribed exposure treatment is performed. Wafer W that has been subjected to exposure treatment is transferred to second delivery stage TRS6 (TRS7) of shelf unit U6 by interface arm B, for delivery to DEV layer B1 (DEV layer B2), wafer W on stage TRS6 (TRS7) is received by main arm A1 (main arm A2) of DEV layer B1 (DEV layer B2), and initially transferred in the order of the heating unit (PEB), the cooling unit (COL), the development unit, and the heating unit (POST) in DEV layer B1 (B2), whereby the prescribed development treatment is performed. Wafer W thus subjected to development treatment is transferred to first delivery stage TRS1 (TRS2) for delivery of wafer W to transfer arm C, and returned by transfer arm C to original carrier 90 placed on carrier block S1.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heat treatment apparatus for successive heat treatment of substrates, comprising:

a hot plate portion for subjecting the substrate to which a coating liquid is applied to heat treatment;

a cooling plate for cooling said substrate;

a drive mechanism for moving said cooling plate between a home position where said substrate is passed between said cooling plate and an external transfer mechanism and a position above said hot plate portion where said substrate is passed between said cooling plate and said hot plate portion;

a heating mechanism for heating said cooling plate;

a temperature detection portion for detecting a temperature of said cooling plate;

a control unit outputting a control signal for controlling an amount of heat received by said cooling plate from said heating mechanism such that a temperature value detected by said temperature detection portion is set to a prescribed temperature before start of successive treatment of said substrate, said control unit outputting said control signal such that a surface temperature of said cooling plate immediately before reception from said hot plate portion of said substrate to be treated first after start of the successive treatment of said substrates and a surface temperature of said cooling plate immediately before reception from said hot plate portion of said substrate to be treated second are brought closer to each other; and a cooling mechanism for forcibly cooling said cooling plate, wherein said cooling mechanism cools said cooling plate by blowing a gas through a discharge port provided above the cooling plate at the home position during cooling of said cooling plate.

2. The heat treatment apparatus according to claim 1, wherein the control unit brings a temperature difference between the surface temperature of said cooling plate immediately before reception from said hot plate portion, of said substrate to be treated first after start of the successive treatment and the surface temperature of said cooling plate immediately before reception from said hot plate portion, of said substrate to be treated second within a range of 10° C.

3. The heat treatment apparatus according to claim 1, wherein said heating mechanism is included in said hot plate portion, and said control signal includes a signal for controlling said drive mechanism based on the temperature detected by said temperature detection portion in order to adjust a time period during which said cooling plate stays above said hot plate portion.

4. The heat treatment apparatus according to claim 1, wherein said heating mechanism is provided in said cooling plate, and said control signal includes a signal for controlling an amount of heat generated by said heating mechanism.

5. The heat treatment apparatus according to claim 1, wherein said substrates include a first substrate and a second substrate treated next to the first substrate, and if a temperature for heat treatment of said second substrate by said hot plate portion is lower than that of said first substrate, said control unit outputs said control signal such that the cooling plate is cooled by said cooling mechanism by a time when said cooling plate receives said second substrate from said external transfer mechanism, after said first substrate is passed from said cooling plate to said external transfer mechanism.

6. The heat treatment apparatus according to claim 1, wherein the discharge port is provided at a plurality of locations above the cooling plate at the home position.

7. A heat treatment apparatus for successive heat treatment of substrates, comprising:

a housing;

a hot plate portion for subjecting the substrate to which a coating liquid is applied to heat treatment;

a cooling plate for cooling said substrate;

a drive mechanism for moving said cooling plate between a home position where said substrate is passed between said cooling plate and an external transfer mechanism and a position above said hot plate portion where said substrate is passed between said cooling plate and said hot plate portion;

a heating mechanism for heating said cooling plate;

a temperature detection portion for detecting a temperature of said cooling plate;

a control unit outputting a control signal for controlling an amount of heat received by said cooling plate from said heating mechanism such that a temperature value detected by said temperature detection portion is set to a prescribed temperature before start of successive treatment of said substrate, said control unit outputting said control signal such that a surface temperature of said cooling plate immediately before reception from said hot plate portion of said substrate to be treated first after start of the successive treatment of said substrates and a surface temperature of said cooling plate immediately before reception from said hot plate portion of said substrate to be treated second are brought closer to each other; and a floor plate, wherein the floor plate divides said housing into an upper region and a lower region across a longitudinal length of the housing.

8. The heat treatment apparatus according to claim 7, wherein a transfer, heat treatment, and cooling of said substrate by said cooling plate and said hot plate portion is configured to be performed in the upper region.

9. The heat treatment apparatus according to claim 7, wherein the heating mechanism is supported by the floor plate.

* * * * *